US006192849B1

(12) United States Patent
Powell

(10) Patent No.: US 6,192,849 B1
(45) Date of Patent: Feb. 27, 2001

(54) MANIFOLD HOUSING SYSTEM

(75) Inventor: Jeffrey J. Powell, Windsor (CA)

(73) Assignee: Siemens Canada Limited, Ontario (CA)

( * ) Notice: Subject to any disclaimer, the term of this patent is extended or adjusted under 35 U.S.C. 154(b) by 0 days.

(21) Appl. No.: 09/336,081

(22) Filed: Jun. 18, 1999

(51) Int. Cl.[7] ..... F02D 9/10
(52) U.S. Cl. ..... 123/184.34
(58) Field of Search ..... 123/189.24, 184.34, 123/184.42, 184.47, 184.53, 184.61

(56) References Cited

U.S. PATENT DOCUMENTS

| | | | | |
|---|---|---|---|---|
| 2,857,893 | * | 10/1958 | Logdell | 123/184.34 |
| 5,477,819 | | 12/1995 | Kopec . | |
| 5,544,629 | | 8/1996 | Ohata . | |
| 5,572,965 | * | 11/1996 | Ohsuga et al. | 123/184.42 |
| 5,575,247 | | 11/1996 | Nakavama et al. . | |
| 5,638,784 | * | 6/1997 | Ohsuga et al. | 123/184.34 |
| 5,713,323 | | 2/1998 | Walsh et al. . | |

FOREIGN PATENT DOCUMENTS

| | | |
|---|---|---|
| 44 03 219 | 8/1995 | (DE) . |
| 196 50 806 | 6/1998 | (DE) . |
| 523 027 | 1/1993 | (EP) . |

* cited by examiner

*Primary Examiner*—Marguerite McMahon

(57) ABSTRACT

A field replaceable unitary manifold housing for providing combustion air and combustion fuel to an internal combustion engine is disclosed. The housing includes an air purification cavity having a spaced apart air intake and air discharge. The housing also includes a filter for purifying air disposed in the air purification cavity intermediate the air intake and the air discharge. The housing also includes a hollow elongate member having a first end coupled to the filter and a second end coupled to a plenum chamber for directing the air, the plenum chamber being integral with the air purification cavity. The housing also includes a plurality of channels, each channel integral with the housing and having a first end integral with the plenum chamber and a second end coupled to a cylinder head of the engine. The air intake induces air into the air purification cavity, the induced air is purified by the filter, the hollow elongate member directs the air from the filter to the plenum chamber, and the plurality of channels direct the air from the plenum chamber to the cylinder head.

17 Claims, 4 Drawing Sheets

MANIFOLD HOUSING SYSTEM

FIELD OF THE INVENTION

The present invention relates generally to a manifold for motor vehicles. In particular, the present invention relates to a manifold system to provide combustion air and combustion fuel to a cylinder head of an internal combustion engine.

BACKGROUND OF THE INVENTION

It is well known to purify raw air in an air cleaner before routing the purified air and combustion fuel through an intake manifold and supplying the air and fuel to an internal combustion engine. Such known air cleaners typically include a filter disposed in a housing. An air exhaust of the air cleaner typically leads to the separate intake manifold. In operation, such known air cleaners provide for the intake of raw air, the purification of the raw air and the routing of the purified air to the air exhaust; such known intake manifolds provide for the routing of the purified air and the combustion fuel to the cylinder head of the engine.

A problem with such known air cleaners and intake manifolds is that such components are separate and distinct. Such separateness and distinctness can result in mechanical incompatibility between such components, the need for additional hoses and tubes to connect such components, decreased accessibility to such components for servicing and a reduction in the physical underhood space available for accessory components.

What is needed, therefore, is a unitary manifold system. It would also be advantageous to have a manifold system capable of rapid installation in an engine. It would further be advantageous to have a manifold system that is readily accessible for rapid service, repair or replacement. It would further be advantageous to provide a manifold system with multiple detachment points for easy servicing.

SUMMARY OF THE PRESENT INVENTION

The present invention relates to a field replaceable unitary manifold housing for providing combustion air and combustion fuel to an internal combustion engine. The housing includes an air purification cavity having a spaced apart air intake and air discharge. The housing also includes a filter for purifying air disposed in the air purification cavity intermediate the air intake and the air discharge. The housing also includes a hollow elongate member having a first end coupled to the filter and a second end coupled to a plenum chamber for directing the air, the plenum chamber being integral with the air purification cavity. The housing also includes a plurality of channels, each channel integral with the housing and having a first end integral with the plenum chamber and a second end coupled to a cylinder head of the engine. The air intake induces air into the air purification cavity, the induced air is purified by the filter, the hollow elongate member directs the air from the filter to the plenum chamber, and the plurality of channels direct the air from the plenum chamber to the cylinder head.

The present invention further relates to a field replaceable unitary manifold housing for providing combustion air and combustion fuel to an internal combustion engine of an automobile. The housing includes an air purification cavity having a spaced apart intake means for inducing air into the air purification cavity and a discharge means for venting air from the housing. The housing also includes means for purifying the induced air being disposed in the air purification cavity intermediate the air intake means and the air discharge means. The housing also includes means for directing air from the air purification cavity to a plenum means for directing the air, the plenum means being integral with the air purification cavity. The housing also includes means for providing fuel to the channel means. The housing also includes channel means for directing air from the plenum means to a cylinder head of the internal combustion engine.

The present invention further relates to a method for coupling a first molded flange of a manifold for providing combustion air and combustion fuel to a cylinder of a vehicular internal combustion engine to a second molded flange of an extension of the manifold. The method includes molding the first flange of the manifold and the second flange of the extension. The method also includes molding an alignment member integral with the second flange. The method also includes forming a first aperture in the first flange. The method also includes forming a second aperture in the alignment member. The method also includes positioning the first flange and the second flange such that the first aperture is generally aligned with the second aperture. The method also includes inserting a threaded insert in the first aperture and at least partially in the second aperture. The method also includes inserting a threaded fastener into the threaded insert such that the fastener is circumscribed by the insert and extends into the first flange and at least partially into the second flange.

It is an object of this invention to provide a unitary manifold housing. It is also an object of this invention to provide a manifold housing that is capable of rapid replacement in an engine. It is a further object of this invention to provide a manifold housing that is readily accessible for rapid servicing, repairing or replacing. It is a further object of this invention to provide a manifold system with multiple detachment points for easy servicing. It is a further object of this invention to decrease manufacturing costs by providing a manifold housing constructed of readily available materials.

Other principal features and advantages of the invention will become apparent to those skilled in the art upon review of the following drawings, the detailed description and the appended claims.

Figure 1:
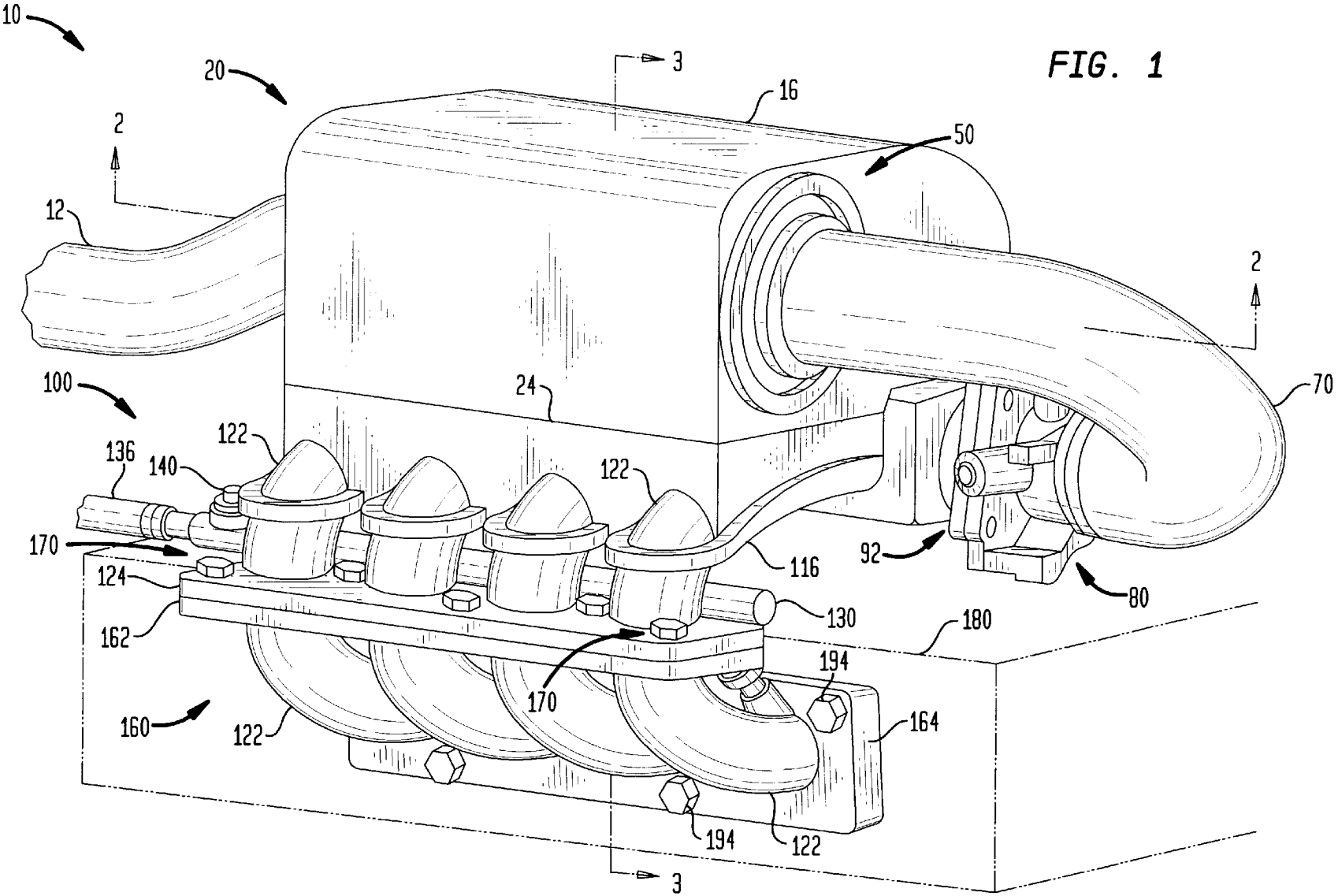
FIG. 1 is a fragmentary perspective view of a manifold system in accordance with a preferred embodiment of the present invention.

Before explaining at least one embodiment of the invention in detail it is to be understood that the invention is not limited in its application to the details of construction and the arrangement of the components set forth in the following description or shown in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

FIG. 1 shows a manifold or housing system 10 for providing a mixture of combustion fuel 134 and purified combustion air 42 to a cylinder head 180 of an internal combustion engine (not shown) according to a preferred embodiment of the present invention. System 10 includes an air induction system 20 mounted to a manifold assembly 100. Air induction system 20 purifies raw air (e.g., atmospheric, ambient, unpurified, dirty air, etc.) and includes an air intake or air induction tube (shown as a dirty air tube 12) partially disposed within a housing 16. An air filter assembly 30 is provided within the interior of housing 16. A hose (shown as an airflow tube 70) is mounted to a filter assembly 30 and serves to direct purified air 42 from filter assembly 30 to a throttle assembly 80. Purified air 42 flows through throttle assembly 80 to a reservoir or plenum chamber (shown as a cavity 22). A system of hollow tubes or channels (shown as manifold runners 122) direct purified air 42 from housing 16 through manifold assembly 100 and a manifold extension 160 to cylinder head 180 of the engine. System 10 is selectively removable from cylinder head 180 for rapid repair, servicing or replacement.

Figure 2:
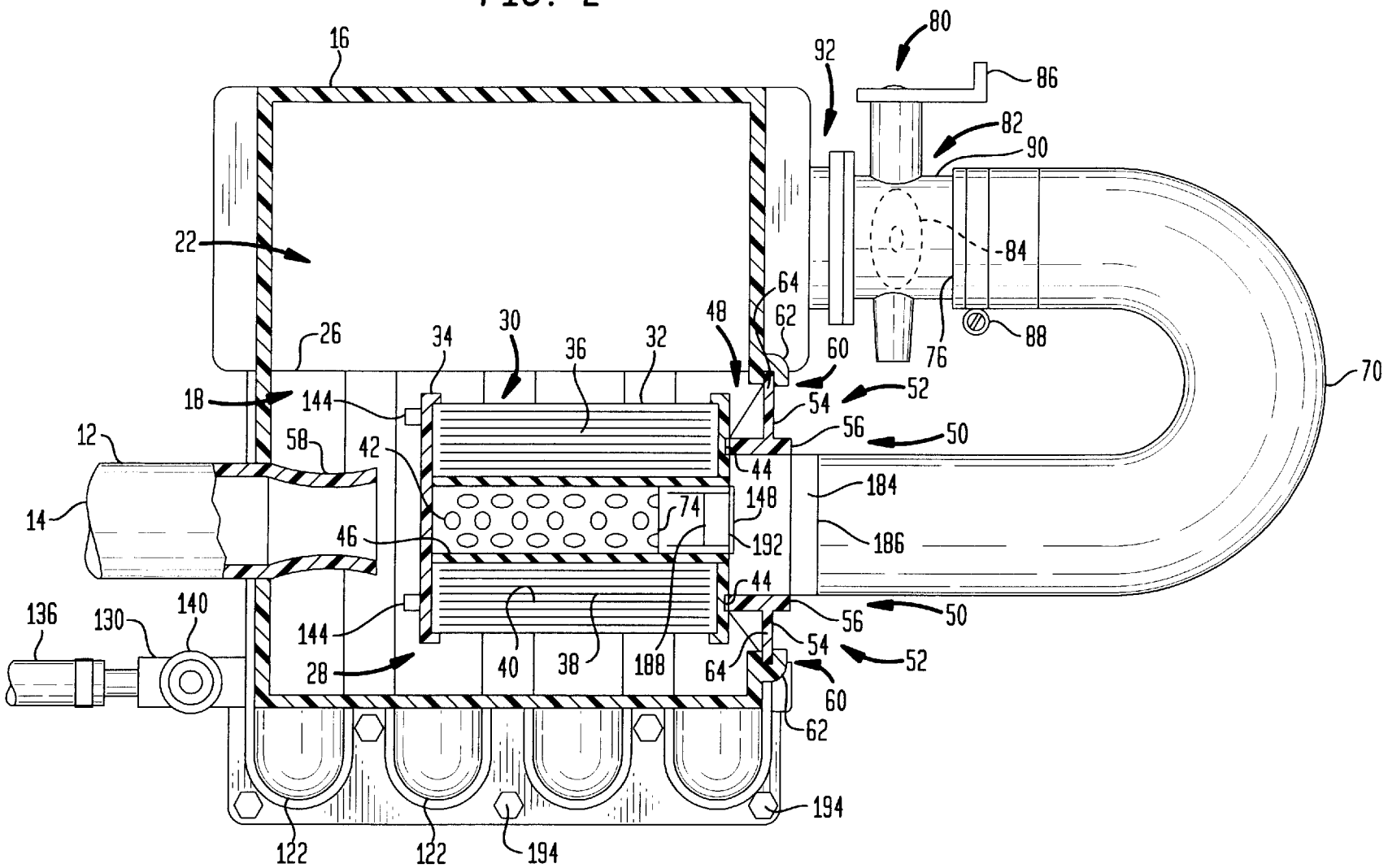
FIG. 2 is a fragmentary section view of the system of FIG. 1 along line 2—2 of FIG. 1.

Referring to FIG. 2, air induction system 20 includes an air induction reservoir or air purification cavity (shown as a cavity 18) and cavity 22 for purified air 42. A partition (shown as a wall 26) separates cavity 18 from cavity 22 such that the raw, dirty or unpurified air stored in cavity 18 is generally sealed or separated from cavity 22. Dirty air tube 12 includes an inlet 14 to direct the raw air from the exterior of housing 16 into cavity 18 of housing 16. An outlet (shown as a tuning tube 58) mounted to dirty air tube 12 further directs the raw air from inlet 14 to cavity 18 of housing 16. The center of tuning tube 58 is narrower than the end (e.g., crimped or horn-shaped with a trumpet-shaped portion). Not wishing to be limited by theory, it is believed that the shape of the outlet may provide an overall noise reduction by matching the natural frequency of the raw air to the frequency of the engine. According to an alternative embodiment, the purified air reservoir may include a number of baffles into which the raw air is directed (i.e., the baffles may further serve to reduce the overall noise level of the manifold system).

Filter assembly 30 is disposed within cavity 18 of housing 16 and may be supported by wall 26. Filter assembly 30 includes a generally circular-shaped air filter element (shown as a canister 32). Canister 32 includes an air receiving surface (shown as an outer wall 36) and an air-emitting surface (shown as an inner wall 46). Raw air stored in cavity 18 enters canister 32 through outer wall 36 and is directed through a filter media (not shown) such as a pretreated or pleated corrugated paper. During the purification or filtering of the raw air by canister 32, impurities (e.g., debris, particulates, gasses, dirt, pollution, etc.) may be entrapped within the filter media. Purified air 42 exits the filter media through inner wall 46 of canister 32. A covering (shown as an end cap 34) circumscribes and surrounds a lower end 28 of canister 32. End cap 34 promotes the entry of raw air through outer wall 36 by covering or blocking lower end 28 of canister 32. A generally flexible, compressible seal 44 is mounted to an upper end 48 of canister 32. Seal 44 extends radially around canister 32 beyond the periphery of an aperture 192 having a diameter 190. A fastener (not shown), such as an adhesive or glue, may secure seal 44 to canister 32. Such fastener may also secure a left end 38 of the filter media to a right end 40 of the filter media. According an alternative embodiment, the seal may be integrally molded to the filter element or the seal may be removably coupled to the filter element.

Airflow tube 70 is generally U-shaped and engages upper end 48 of canister 32 to provide a conduit for directing purified air 42 from canister 32 to throttle assembly 80. An end portion 72 of airflow tube 70 is provided at least partially within canister 32. (End portion 72 has a diameter 188 less than a diameter 186 of an inlet 74 of airflow tube 70 and less than diameter 190 of aperture 192 of canister 32.) In operation of air induction system 20, purified air 42 is directed from canister 32 through end portion 72 to inlet 74 of airflow tube 70.

Throttle assembly 80 regulates the amount of purified air 42 directed from air induction system 20 to cylinder head 180 of the engine. A fastener (shown as a capture clamp 88) mounts a throttle valve 90 of throttle assembly 80 to an outlet 76 of airflow tube 70. (The diameter of outlet 76 is greater than the diameter of throttle valve 90 such that throttle valve 90 may be inserted into outlet 76 and secured by a capture clamp 88.) Throttle assembly 80 includes a choke assembly 82 providing a flap 84 controlled by a lever 86 to regulate the amount of purified air 42 that passes through choke assembly 82. After passing through throttle assembly 80, purified air 42 is directed into cavity 22 of housing 16, and ultimately to cylinder head 180 of the engine. According to an alternative embodiment, the flap of the choke assembly may be controlled by a computer system.

Figure 5:
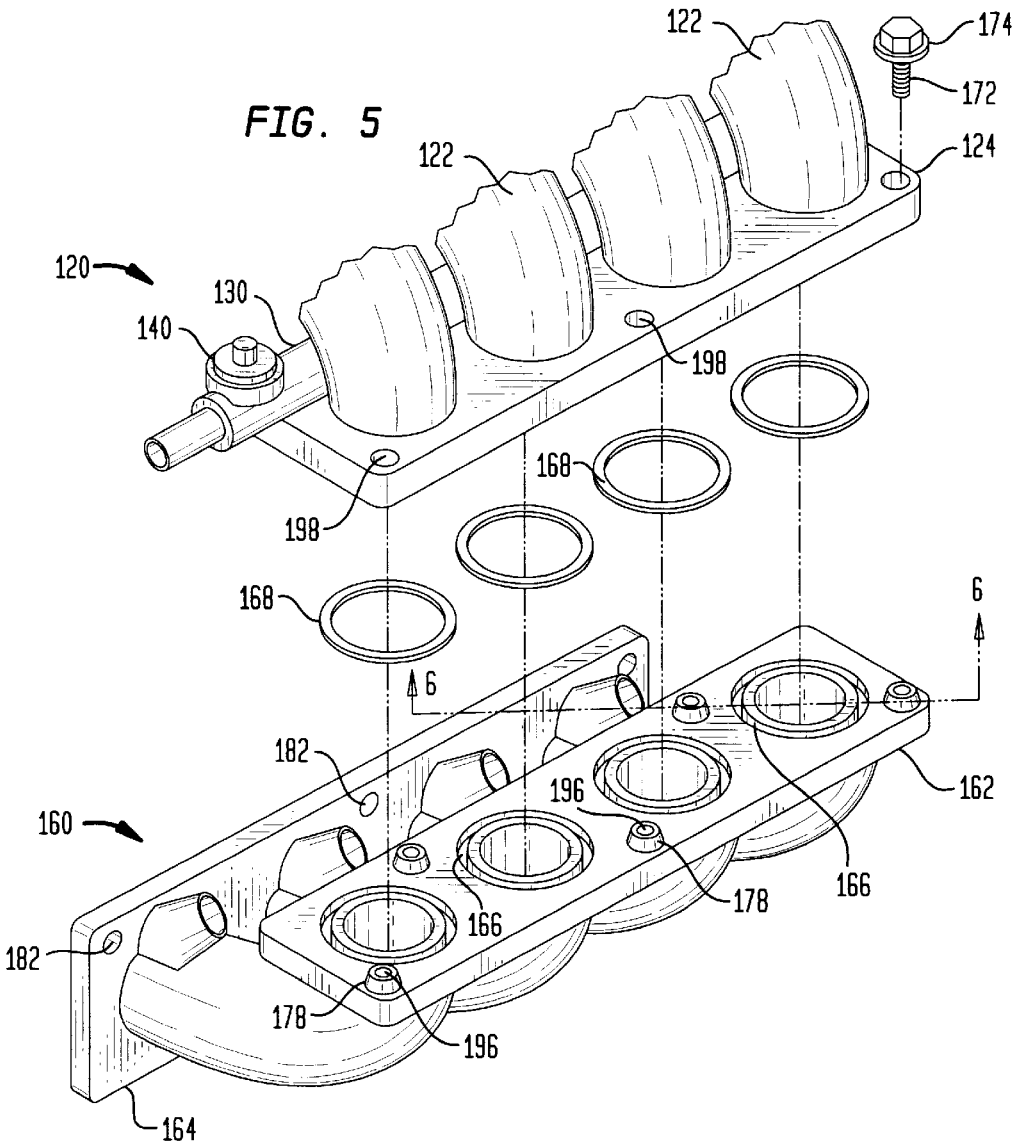
FIG. 5 is a fragmentary exploded perspective view of a lower plenum and manifold assembly.
Figure 6:
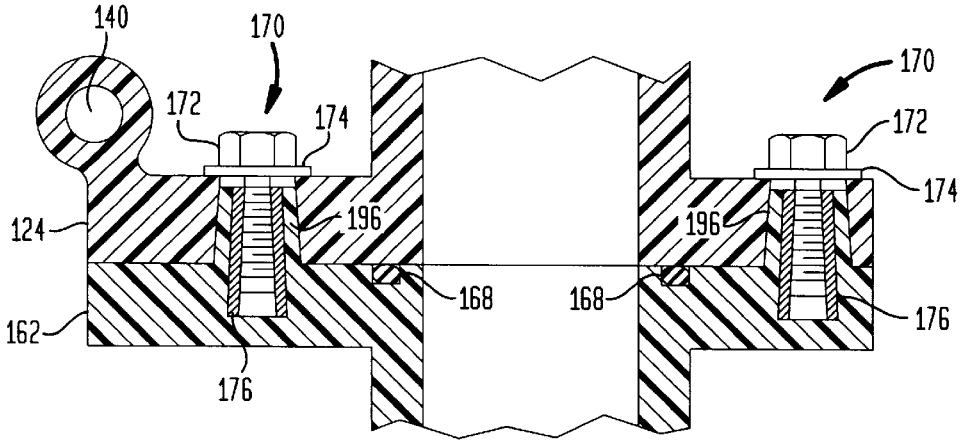
FIG. 6 is a fragmentary section view of the lower plenum and manifold assembly of FIG. 5 along line 6—6 of FIG. 5.

Referring to FIG. 5, manifold assembly 100 includes a service plenum 114 mounted to a manifold extension 160 by a fastener assembly 170 (see FIG. 6). Manifold assembly 100 includes runners 122 to direct purified air 42 from cavity 22 to cylinder head 180 of the engine. Runners 122 span manifold assembly 100 and manifold extension 160. According to alternative embodiments, the manifold system may contain any number of channels or runners in any configuration (e.g., a manifold system adapted to provide combustion air and combustion fuel to the cylinder head of a V-8 or straight-6 internal combustion engine as is known in the automotive arts).

Figure 3:
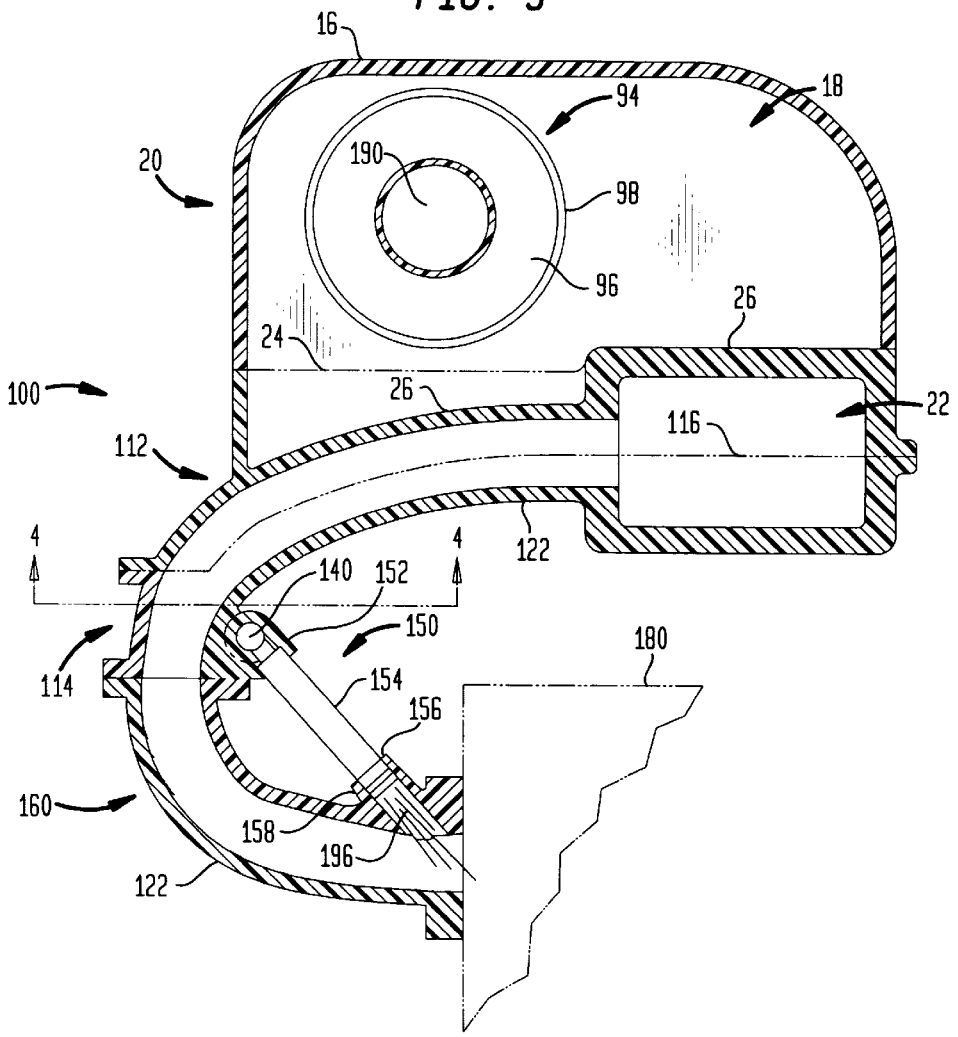
FIG. 3 is a fragmentary section view of the system of FIG. 1 along line 3—3 of FIG. 1.

Manifold assembly 100 is selectively removable from manifold extension 160 such that manifold system 10 may be easily accessed for repair or replacement. Referring to FIG. 3, manifold assembly 100 includes upper plenum 112, service plenum 114 having a service flange 124 and a common fuel source or fuel conduit (shown as a fuel rail 130). A weld joint (shown as a flange 24) integrally connects the upper end of upper plenum 112 to housing 16. The lower end of upper plenum 112 is integrally connected to the upper end of service plenum 114 by a weld joint (shown as a flange 116). According to a preferred embodiment, the weld joint between the upper plenum and the service plenum is flared outwardly such that the interior of the runner is generally smooth for optimum airflow through the runner.

Referring to FIG. 6, fastener assembly 170 connects service flange 124 of service plenum 114 to a service flange 162 of manifold extension 160. To connect service flange 124 to service flange 162, an aperture (shown as a bore 198) having a slight inward taper is aligned with a protrusion or alignment pin (shown as a post 178) of service flange 162. An aperture (shown as an inner bore 196) having a slight outward flare is provided within the interior of post 178 and extends into the interior of service flange 162. A spacer (shown as a generally circular-shaped, hollow, threaded insert 176) is inserted into bore 198 of service flange 124 and extends into bore 196 of post 178 such that threaded insert 176 is generally flush with the surface of service flange 124. A fastener (shown as a threaded, hexagonal-headed, machine screw 172), the head of which is circumscribed by a spacer (shown as a washer 174), is inserted into threaded insert 176. A seal (shown as an O-ring 168) is provided in a groove 166 of service flange 162 to inhibit purified air 42 from leaking from manifold system 10. The protrusions may be molded to the service flange by any known method such as blow molding, vibration welding, friction welding, etc. Any known method such as boring, drilling, molding, etc. may form the apertures. According to a preferred embodiment as shown in FIG. 6, the inner bore of the service flange is a "blind" bore such that the aperture of the bore does not extend all the way through the service flange of the manifold assembly.

Figure 4:
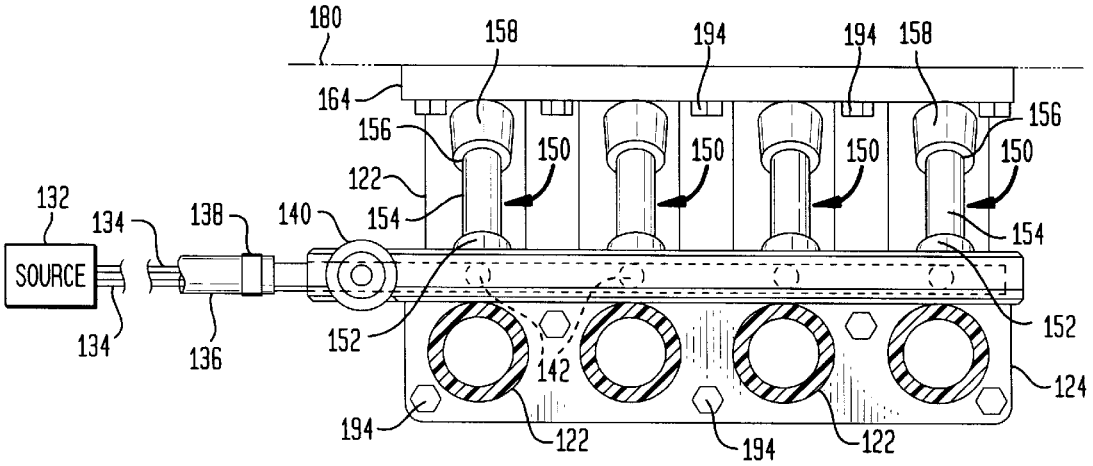
FIG. 4 is a fragmentary perspective view of a lower plenum and manifold assembly.

Referring to FIGS. 4 and 5, a suitable fastener (e.g., a vibration weld) mounts fuel rail 130 to service plenum 114. A fastener (shown as a capture clamp 138) connects fuel rail 130 to a duct (shown as a hose 136) of a fuel source 132 (see FIG. 4). A control device (shown as a fuel regulator 140) controls the amount of fuel 134 provided to fuel rail 130. According to an alternative embodiment as shown in FIG. 4, fuel regulator 140 may be a returnless fuel regulator (as is known in the automotive arts) that inhibits the "back flow" of fuel 134 from fuel rail 130 back into to fuel source 132. An aperture 142 provides a passage for fuel 134 to be directed from fuel rail 130 to a conduit (as shown best in FIG. 4 as a top feed fuel injector 150). In operation of manifold assembly 100, fuel 134 is directed from fuel rail 130, through aperture 142 and to an inlet 152 of injector 150. Fuel 134 flows from inlet 152 to a passageway 154 of injector 150, and end exits injector 150 through an outlet 156 to an injector bore 158 of manifold extension 160. Fuel 134 is dispersed from injector bore 158 as a fuel spray 128. Ultimately, fuel spray 128 and purified air 42 are mixed at cylinder head 180. A fastener (shown as a hexagonal-headed machine screw 194) is inserted through an aperture 182 to mount a cylinder flange 164 of manifold extension 160 to cylinder head 180 of the engine. According to an alternative embodiment, a seal (e.g., O-ring) may be provided between a seal groove of the cylinder flange and the cylinder head. According to other alternative embodiments, the fuel rail may be molded to the service flange of the manifold assembly.

Referring to FIG. 2, a locking mechanism (shown as a twist lock system 50) selectively connects filter assembly 30 to airflow tube 70 such that filter assembly 30 may be readily removed from cavity 18 of housing 16. To engage and disengage twist lock system 50, airflow tube 70 is rotated about ninety degrees. Twist lock system 50 includes a tube connector system 52 and a housing connector system 60. Housing connector system 60 includes a number of outwardly extending protrusions (shown as a finger 62) and a number of inwardly extending indentations (shown as finger 64) spaced generally evenly about the periphery of an aperture 184 of cavity 18. Tube connector system 52 includes reciprocal outwardly extending protrusions (shown as a finger 54) and inwardly extending indentations (not shown) spaced generally evenly about the periphery of a flange 56 of airflow tube 70. To create an effective closure or connection between filter assembly 30 and airflow tube 70, a compressive force is applied to airflow tube 70 to compress seal 44 (which may be a flexible seal) between a seal engaging surface of flange 56 and canister 32. (A stop mechanism 144 applies an opposite force to end cap 34 of filter assembly 30.) Finger 54 of tube connector system 52 is aligned with and inserted into finger 64 of housing connector system 60. Finger 54 is rotated relative to housing 16 (or vice versa) such that finger 54 is aligned with finger 62 of housing connector system 60 (i.e., the finger of the housing connector system and the tube connector system are rotated until they are intertwined and interconnected). The compression of seal 44 and the interconnection of finger 54 and finger 62 maintain such compressive force. According to an alternative embodiment, an indexing system may be provided to inhibit further rotation of the airflow tube relative to the housing (i.e., such rotation may cause a disconnection between the outwardly extending protrusion of the housing connector system and the outwardly extending protrusion of the tube connector system).

Referring to FIGS. 2 and 3, a locking mechanism 92, similar to twist lock system 50, may connect throttle assembly 80 to cavity 22 housing 16. According to an alternative embodiment as shown in FIG. 3, a locking assembly 94 may connect throttle assembly 80 to cavity 22 of housing 16. Locking assembly 94 includes an aperture 148 circumscribed by a flexible tapered portion 96 and adapted to receive throttle valve 90. A flexible seal 98 may be positioned between cavity 22 and throttle assembly 80 to inhibit purified air 42 from leaking from throttle assembly 80 to the exterior of housing 16. According to other alternative embodiments, the air induction tube may be connected to the housing by a locking mechanism similar to twist lock system 50 shown in FIG. 2.

According to a particularly preferred embodiment, the manifold system purifies raw air before the raw air is routed to the cylinders of an automotive or vehicular engine. The air induction housing, the plenum assembly, the manifold assembly and the fuel rail are preferably constructed of plastic. The plenum assembly is vibration welded to the housing, and the upper plenum is vibration welded to the service plenum. Preferably, the vibration welding operation is conducted at about 120 hertz. The fuel rail is molded to the upper plenum and has a diameter of about one inch. The filter element holds about one quart of purified air and the filter media is preferably constructed of paper folded in a zigzag configuration. The cover of the filter assembly is preferably constructed of aluminum metal and is encapsulated in urethane. The seal of the filter assembly is preferably generally "V"-shaped and constructed of urethane rubber. The height of each of the protrusions of the fastener assembly is substantially identical to the thickness of the service flange of the manifold assembly. The aperture of the protrusion of the fastener assembly is preferably deeper than the length of the threaded insert, which is preferably constructed of brass. The O-ring seals are preferably constructed of urethane rubber.

While a preferred embodiment of the invention is as described above, there are several substitutions that may be made without departing from the beneficial features of the above-described invention such as variations in sizes, structures, shapes and proportions of the various elements, values of parameters, mounting arrangements, or use of materials. For example, according to an alternative embodiment the fuel rail may be molded or integral with the service flange of the manifold assembly. The fuel rail may be mounted to either the upper plenum or to the manifold assembly. The regulator of the fuel rail may be positioned within the housing. Any suitable fastening device (e.g., welding, ultrasonic welding, vibration welding, molding, glue, screws, rivets, clamps or other conventional methods) may attach the housing to the plenum assembly and may attach the upper plenum to the service plenum.

According to other alternative embodiments associated with the filter assembly, the filter element may be disposable. The filter material may be constructed of a porous material (e.g., cardboard, corrugated paper, carbon block, etc.) or a natural or synthetic fibrous material (e.g., spun polyethylene, glass wool, microbial filter, etc.). The effective closure or seal between the tube connector system and the housing connector system may be formed by any known connection system (such as a bayonet connector system, a threaded connection, a clamp, etc.) and may be maintained by any locking mechanism (e.g., a detent, a tumbler lock, a tacky adhesive, etc.). The seal of the filter assembly may be round-shaped, V-shaped, diamond-shaped or any other shape or configuration. The seal of the filter assembly may be mounted to the housing, fixed to a rigid or semi-rigid framework that also extends about the periphery of the filter element, or detached from both the housing and the filter element. The seal of the filter assembly may be positioned between the filter element and the airflow tube or between the airflow tube and the housing. A panel-type filter assembly may be mounted directly to the plenum.

It should be noted that the use of the term "conduit" is not meant as a term of limitation, insofar as any valve, hose, tube, passage or like structure providing a channel or passageway through which air may flow is intended to be included in the term. It should also be noted that the use of the term "directed" is not meant as a term of limitation, insofar as any routing or leading of raw air, purified air or fuel into, through and out of the air induction system and the manifold system is intended to be included in the term. It should also be noted that the use of the term "engine" is not meant as a term of limitation, insofar as any "engine" or like machine for using fuel to produce motion is intended to be included in the term.

Thus, it should be apparent that there has been provided in accordance with the present invention a manifold system that fully satisfies the objectives and advantages as set forth above. Although the invention has been described in conjunction with specific embodiments thereof, it is evident that many alternatives, modifications and variations will be apparent to those skilled in the art. Accordingly, the invention is intended to embrace all such alternatives, modifications and variations that fall within the spirit and broad scope of the appended claims. Other substitutions, modifications, changes and omissions may be made in the design, operating conditions and arrangement of the preferred embodiments without departing from the spirit of the invention as expressed in the appended claims.

What is claimed is:

1. A field replaceable unitary manifold housing for providing combustion air and combustion fuel to an internal combustion engine, comprising:

an air purification cavity having a spaced apart air intake and air discharge;

a filter for purifying air mounted to the air discharge and disposed in the air purification cavity intermediate the air intake and the air discharge;

a hollow elongate member having a first end coupled to the filter and a second end coupled to a plenum chamber for directing the air, the plenum chamber being separated from the air purification cavity by a common partition;

a plurality of channels, each channel integral with the housing and having a first end integral with the plenum chamber and a second end coupled to a cylinder head of the engine;

wherein the air intake induces air into the air purification cavity, the induced air is purified by the filter, the hollow elongate member directs the air from the filter to the plenum chamber, and the plurality of channels direct the air from the plenum chamber to the cylinder head.

2. The housing of claim 1, further comprising a common fuel source for providing fuel to the cylinder head coupled to the plurality of channels and intermediate the air intake and air discharge.

3. The housing of claim 2, wherein the housing and the fuel source are plastic.

4. The housing of claim 3, further comprising a throttle valve disposed in the hollow elongate member.

5. The housing of claim 4, further comprising a flexible seal disposed intermediate the filter and the hollow elongate member.

6. The housing of claim 5, wherein a channel of the plurality of channels further comprises a first portion having a first flange and being separable from a second portion having a second flange.

7. The housing of claim 6, wherein the fuel source is a fuel rail molded to the first flange of the first portion of a channel of the plurality of channels, and further comprising a return-less fuel regulator mounted to the fuel rail.

8. The housing of claim 7, wherein a twist lock fastening member couples the filter to the elongate member.

9. The system of claim 8, further comprising an alignment pin extending from the first flange of the first portion and having a first aperture, a second aperture in the second flange of the second portion, a threaded insert disposed in the second aperture and at least partially in the first aperture, and a fastener circumscribed by the threaded insert such that the first aperture is generally aligned with the second aperture and the fastener extends through the second aperture and into at least partially into the first aperture.

10. A field replaceable unitary manifold housing for providing combustion air and combustion fuel to a internal combustion engine of an automobile, comprising:

an air purification cavity having a spaced apart intake means for inducing air into the air purification cavity and a discharge means for venting air from the housing;

means for purifying the induced air being mounted to the discharge means and disposed in the air purification cavity intermediate the air intake means and the air discharge means;

means for directing air from the air purification cavity to a plenum means for directing the air, the plenum means being separated from the air purification cavity by a common partition;

fuel means for providing fuel to a channel means; and channel means for directing air from the plenum means to a cylinder head of the internal combustion engine.

11. The housing of claim 10, wherein the means for directing air is a hollow elongate member and further comprising a throttle valve disposed in the hollow elongate member.

12. The housing of claim 11, wherein the housing and the means for providing fuel are plastic.

13. The housing of claim 12, wherein the channel means further comprises a first portion having a first flange separable from a second portion having a second flange.

14. The housing of claim 13, wherein the fuel means is a fuel rail and the fuel rail further comprises a fuel injector.

15. The housing of claim 14, wherein a first end of the elongate member is separable from the filter means and a second end of the elongate member is separable from the plenum means.

16. The system of claim 15, wherein the air purification cavity is vibration welded to the plenum means.

17. The housing of claim 16, wherein a first twist lock mechanism couples the first end of the elongate member to the filter means and a second twist lock mechanism couples the second end of the elongate member to the plenum means.

* * * * *